US010388506B2

(12) United States Patent
Yang et al.

(10) Patent No.: US 10,388,506 B2
(45) Date of Patent: Aug. 20, 2019

(54) TIME-OF-FLIGHT MASS SPECTROMETER USING A COLD ELECTRON BEAM AS AN IONIZATION SOURCE

(71) Applicant: Korea Basic Science Institute, Cheongju-si, Chungcheongbuk-do (KR)

(72) Inventors: Mo Yang, Daejeon (KR); Seung Yong Kim, Daejeon (KR); Hyun Sik Kim, Daejeon (KR); Wan Seop Jeong, Jincheon-gun (KR)

(73) Assignee: Kora Basic Science Institute, Cheongju-si, Chungcheongbuk-do (KR)

( * ) Notice: Subject to any disclaimer, the term of this patent is extended or adjusted under 35 U.S.C. 154(b) by 92 days.

(21) Appl. No.: 15/321,563

(22) PCT Filed: Dec. 4, 2015

(86) PCT No.: PCT/KR2015/013252
§ 371 (c)(1),
(2) Date: Dec. 22, 2016

(87) PCT Pub. No.: WO2016/108451
PCT Pub. Date: Jul. 7, 2016

(65) Prior Publication Data

US 2017/0294298 A1 Oct. 12, 2017

(30) Foreign Application Priority Data

Dec. 30, 2014 (KR) ..... 10-2014-0194149
Dec. 3, 2015 (KR) ..... 10-2015-0171695

(51) Int. Cl.
*H01J 49/40* (2006.01)
*H01J 49/08* (2006.01)
(Continued)

(52) U.S. Cl.
CPC ..... *H01J 49/40* (2013.01); *H01J 43/10* (2013.01); *H01J 49/08* (2013.01); *H01J 49/142* (2013.01); *H01J 49/147* (2013.01); *H01J 43/246* (2013.01)

(58) Field of Classification Search
None
See application file for complete search history.

(56) References Cited

U.S. PATENT DOCUMENTS 2,743,370 A 4/1956 McLaren et al.
5,659,170 A 8/1997 Da Silveira et al.
(Continued)

FOREIGN PATENT DOCUMENTS

JP 2014-078504 5/2014
KR 2004-0034252 4/2004
(Continued)

OTHER PUBLICATIONS

International Search Report corresponding to International Application No. PCT/KR2015/013252, dated Aug. 30, 2016.
(Continued)

*Primary Examiner* — James Choi
(74) *Attorney, Agent, or Firm* — McAndrews, Held & Malloy, Ltd.

(57) ABSTRACT

Provided is a time-of-flight mass spectrometer including: an ionization part receiving electron beams to thereby emit ions; a cold electron supply part injecting the electron beams to the ionization part; an ion detection part detecting the ions emitted from the ionization part; and an ion separation part connecting the ionization part and the ion detection part, wherein the cold electron supply part includes a microchannel plate receiving ultraviolet rays to thereby emit the electron beams, the ions emitted from the ionization part pass through the ion separation part to thereby reach the ion
(Continued)

detection part, and the ion separation part has a straight tube shape.

19 Claims, 4 Drawing Sheets

(51) Int. Cl.

| | |
|---|---|
| ***H01J 49/14*** | (2006.01) |
| ***H01J 43/10*** | (2006.01) |
| *H01J 43/24* | (2006.01) |

(56) References Cited

U.S. PATENT DOCUMENTS

| | | | | |
|---|---|---|---|---|
| 9,230,791 | B2 | 1/2016 | Kim et al. | |
| 2002/0123153 | A1* | 9/2002 | Moon | G01N 30/6095 436/173 |
| 2003/0057378 | A1 | 3/2003 | Pierrejean et al. | |
| 2003/0111597 | A1* | 6/2003 | Gonin | H01J 49/025 250/287 |
| 2011/0073754 | A1 | 3/2011 | Sittler | |
| 2011/0234233 | A1 | 9/2011 | Brucker | |
| 2012/0112056 | A1* | 5/2012 | Brucker | H01J 49/4245 250/282 |
| 2012/0145893 | A1* | 6/2012 | Vestal | H01J 49/403 250/286 |
| 2012/0326022 | A1* | 12/2012 | Kumano | H01J 49/0409 250/282 |
| 2014/0124662 | A1* | 5/2014 | Yang | H01J 49/0022 250/288 |
| 2014/0339423 | A1* | 11/2014 | Kim | H01J 49/0022 250/288 |
| 2014/0367568 | A1* | 12/2014 | Kim | H01J 43/04 250/288 |
| 2015/0162178 | A1 | 6/2015 | Kim et al. | |
| 2017/0221690 | A1* | 8/2017 | Brown | H01J 49/0422 |

FOREIGN PATENT DOCUMENTS

| | | | | |
|---|---|---|---|---|
| KR | 2013-0031180 | | 3/2013 | |
| KR | 2013-0031181 | | 3/2013 | |
| KR | 2015-0065493 | | 6/2015 | |
| WO | 01-78880 | | 10/2001 | |
| WO | WO 2013042829 | A1 * | 3/2013 | H01J 49/0022 |
| WO | WO 2013042830 | A1 * | 3/2013 | H01J 49/0022 |
| WO | 2013-081195 | | 6/2013 | |
| WO | WO 2013081195 | A1 * | 6/2013 | H01J 43/04 |

OTHER PUBLICATIONS

Hong et al., The Transactions of the Korean Institute of Electrical Engineers vol. 61, No. 7, pp. 1001-1006, 2012, A Carbon Nanotube Field Emitter with a Triode Configuration for a Miniature Mass Spectrometer.

Communication pursuant to Rule 164(1) EPC dated Feb. 26, 2018 with Supplemental European Search Report corresponding to European Patent Application No. 15875545.4.

Examination Report dated Feb. 20, 2018 corresponding to Japanese Patent Application No. 2016-575356.

Mass Spectrometry, Published Dec. 31, 2007, Apr. 20, 2008, First Edition Second print, Author J. H. Gross; ISBN 978-4-431-10016-4 C3043, 2007, http://www.springer.jp.

Chiba, Kunihiko, et al., "Desorption of tritiated water on materials by photon and electron irradiation," Department of Quantum Engineering and Systems Science,The University of Tokyo 7-3-1 Hongo, Bunkyo-ku, Tokyo 113, Japan, Fusion Engineering and Design 61-62, 2002, Elsevier Science B.V., pp. 775-781.

Madey, Theodore, et al., Surface Processes and Catalysis Section, National Bureau of Standards, "Desorption Methods as Probes of Kinetics and Bonding at Surfaces," Surface Science 63, 1977, North-Holland Publishing Company, pp. 203-231.

Ickert, R.B., et al., "Determining high prescision, in situ, oxygen isotope ratios with a SHRIMP II, et al.," Chemical Geology 257, 2008, Elsevier Science B.V., pp. 114-128.

Madey, Theodore, Surface Science Division, National Bureau of Standards, "The Role of Steps and Defects in Electron Stimulated Desorption, et al.," Surface Science 94, 1980, North-Holland Publishing Company, pp. 483-506.

* cited by examiner

TIME-OF-FLIGHT MASS SPECTROMETER USING A COLD ELECTRON BEAM AS AN IONIZATION SOURCE

CROSS-REFERENCE TO RELATED APPLICATIONS

This application is a 371 of International Patent Application No. PCT/KR2015/013252, filed on Dec. 4, 2015, entitled "TIME-OF-FLIGHT MASS SPECTROMETER", which claims priority to Korean Patent Application No. 10-2014-0194149, filed on Dec. 30, 2014, and Korean Patent Application No. 10-2015-0171695, filed on Dec. 3, 2015. The above-identified applications are hereby incorporated herein by reference in their entirety.

TECHNICAL FIELD

The present invention disclosed herein relates to a time-of-flight mass spectrometer, and more particularly, to a time-of-flight mass spectrometer using a cold electron beam as an ionization source.

BACKGROUND ART

Time-of-flight mass spectrometers can ionize molecules having masses different from each other in a sample and measure current of generated ions. Time-of-flight mass spectrometers may be classified into various types according to methods of separating ions.

A time-of-flight mass spectrometer is one of mass spectrometers. Time-of-flight mass spectrometers can measure masses of ions by using time-of flight of the ions. For an accurate mass spectrometry, a difference in ionizing time is minimized and electrons are thereby allowed to collide with a sample.

DISCLOSURE OF THE INVENTION

Technical Problem

The present invention provides a time-of-flight mass spectrometer having a high accuracy.

The present invention also provides a time-of-flight mass spectrometer suitable to be made smaller.

However, the problems to be solved by the present invention are not limited to the above disclosure.

Technical Solution

Embodiments of the present invention provide time-of-flight mass spectrometers including: an ionization part receiving electron beams to thereby emit ions; a cold electron supply part injecting the electron beams to the ionization part; an ion detection part detecting the ions emitted from the ionization part; and an ion separation part connecting the ionization part and the ion detection part, wherein the cold electron supply part includes a microchannel plate receiving ultraviolet rays to thereby emit the electron beams, the ions emitted from the ionization part pass through the ion separation part to thereby reach the ion detection part, and the ion separation part has a straight tube shape.

In an embodiment, the cold electron supply part may further include an ultraviolet diode emitting the ultraviolet rays toward the microchannel plate.

In an embodiment, the microchannel plate may include: a front surface plate receiving the ultraviolet rays to thereby generate electrons; and a rear surface plate emitting the electron beams, wherein the electron beams may be electrons multiplied in the microchannel plate.

In an embodiment, the multiplication ratio may be about $10^4$ times to about $10^9$ times.

In an embodiment, the cold electron supply part may further include a channeltron electron multiplier multiplying the electron beams emitted from the microchannel plate.

In an embodiment, the channeltron electron multiplier may multiply the electron beams emitted from the microchannel plate by about $10^4$ times to about $10^9$ times.

In an embodiment, the cold electron supply part further may include an ion lens focusing the electron beams multiplied through the channeltron electron multiplier to thereby emit the electron beams toward the ionization part.

In an embodiment, the cold electron supply part may further include a gate electrode blocking or allowing the electron beams emitted from the ion lens to be injected into the ionization part.

In an embodiment, the ion detection part may receive the ions to thereby generate, amplify, and detect electrons and may include a microchannel plate or channeltron electron multiplier which amplifies the electrons.

In an embodiment, the time-of-flight mass spectrometer may have an inner space in vacuum.

In an embodiment, the time-of-flight mass spectrometer may have a pressure of about $10^{-10}$ Torr to about $10^{-4}$ Torr in the inner space.

In an embodiment, the ionization part may include: a sample part on which the sample collides with the electron beams to thereby generate ions; and a sample supply part supplying the sample on the sample part.

In an embodiment, the sample supply part may spray a gas sample to the sample part and the gas sample may be adsorbed on an upper surface of the sample part.

In an embodiment, the sample supply part may supply the gas sample on the sample part through a pulse method.

In an embodiment, the sample supply part may spray a gas sample to the sample part and the gas sample may be adsorbed on an upper surface of the sample part.

Advantageous Effects

According to an embodiment of the present invention, a time-of-flight mass spectrometer in which differences in ionization times of ions are small may be provided. Accordingly, the accuracy of the time-of-flight mass spectrometer may be high.

According to an embodiment of the present invention, time-of-flight mass spectrometers which have small power consumption and high accuracy may be provided. Accordingly, time-of-flight mass spectrometers suitable for miniaturization may be provided.

However, the effects of the present invention are not limited to the above disclosure.

MODE FOR CARRYING OUT THE INVENTION

For sufficient understanding of the configuration and effects of the present invention, exemplary embodiments of the present disclosure will be described in detail with reference to the accompanying drawings. The present invention may, however, be embodied in many alternate forms and should not be construed as limited to only the embodiments set forth herein. Rather, these embodiments are provided so that this disclosure will be thorough and complete, and will fully convey the scope of the present disclosure to those skilled in the art.

Figure 1:
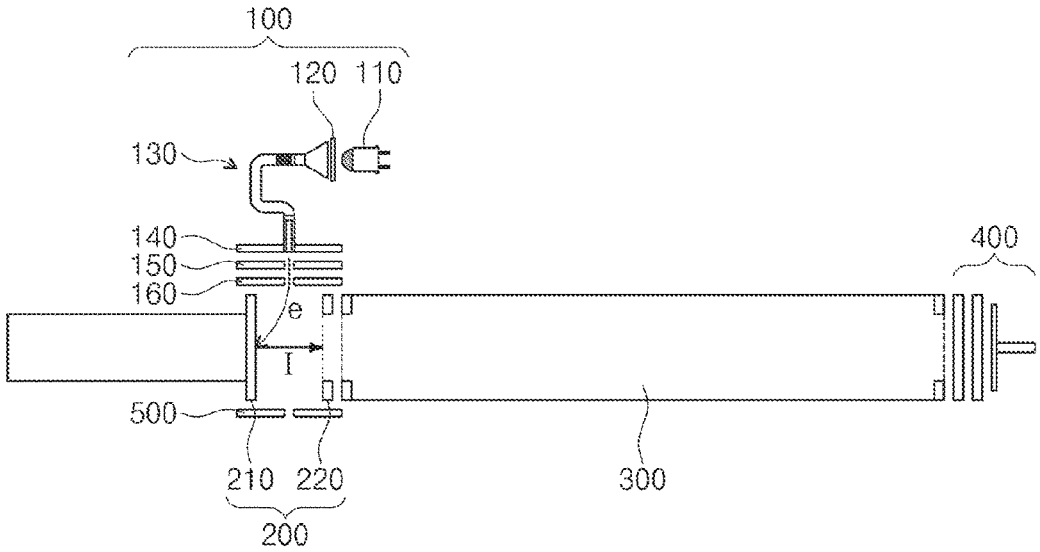
FIG. 1 is a cross-sectional view illustrating a time-of-flight mass spectrometer according to an embodiment of the present invention.
Figure 2:
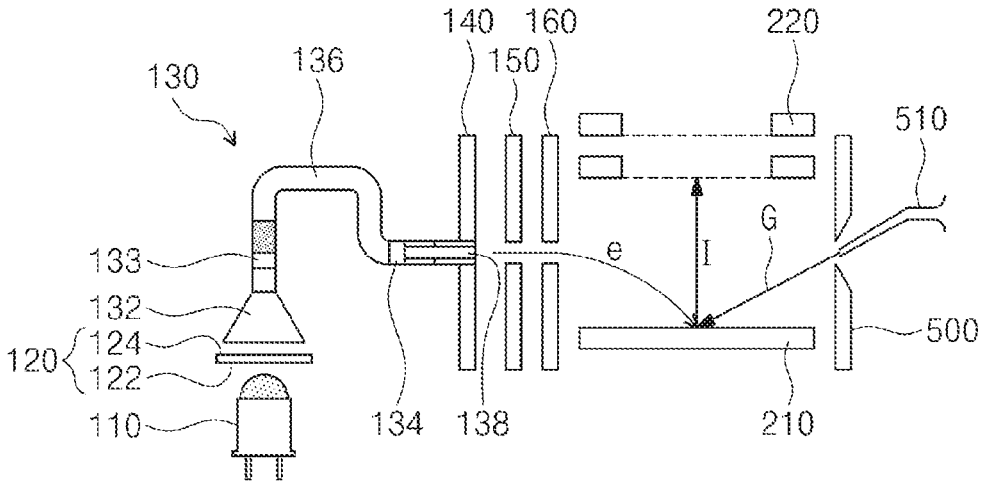
FIG. 2 is a cross-sectional view illustrating a cold electron supply part and an ionization part of a time-of-flight mass spectrometer according to an embodiment of the present invention.

FIG. 1 is a cross-sectional view illustrating a time-of-flight mass spectrometer according to an embodiment of the present invention. FIG. 2 is a cross-sectional view illustrating a cold electron supply part and an ionization part of a time-of-flight mass spectrometer according to an embodiment of the present invention.

Referring to FIGS. 1 and 2, a cold electron supply part 100 may be provided. The cold electron supply part 100 may not emit hot electrons but emit cold electrons using ultraviolet rays. The cold electron supply part 100 may include: an ultraviolet (UV) diode 110 emitting ultraviolet rays; a microchannel plate (MCP) 120 generating, multiplying, and emitting electron beams 'e' by using the ultraviolet rays; a channeltron electron multiplier 130 multiplying and emitting the electron beams 'e'; an inlet electrode 140 allowing the electron beams 'e' to be emitted without loss; an ion lens 150 focusing the electron beams 'e'; and a gate electrode 160 capable of controlling whether to emit the electron beams 'e'. The inner space of the cold electron supply part 100 may be substantially in a vacuum state. In an example, the inner space of the cold electron supply part 100 may have a pressure of about $10^{-10}$ Torr to about $10^{-4}$ Torr.

The ultraviolet diode 110 may radiate ultraviolet rays toward the microchannel plate 120. Since the ultraviolet diode 110 uses current of several to several hundred mA level for several to several hundred micro-seconds, power consumption thereof may be small.

The microchannel plate 120 facing the ultraviolet diode 110 may be provided. The microchannel plate 120 may generate, multiply, and emit electron beams 'e' by using ultraviolet rays. The microchannel plate 120 may have a front surface plate 122 facing the ultraviolet diode 110 and a rear surface plate 124 disposed on the side opposite to the front surface plate 122. The front surface plate 122 may accommodate ultraviolet rays provided from the ultraviolet diode 110 to thereby generate photoelectrons. The front surface plate 122 may have a negative voltage. For example, the voltage of the front surface plate 122 may be about −3000 V to about −1000V. Photoelectrons may be multiplied inside the microchannel plate. Multiplied photoelectrons may be referred to as electron beams 'e'. In an example, electron beams 'e' may be multiplied about $10^4$ to about $10^9$ times more than photoelectrons. The rear surface plate 124 may emit the multiplied electron beams 'e'. The rear surface plate 124 may have a negative voltage. For example, the voltage of the rear surface plate 124 may be about −3000 V to about −1000V. The rear surface plate 124 may emit the electron beams 'e' toward the channeltron electron multiplier 130.

The channeltron electron multiplier 130 may multiply the electron beams 'e' provided from the microchannel plate 120. The channeltron electron multiplier 130 may include an injection port 132, a first electrode 133, a multiplying tube 136, a second electrode 134, and an outlet port 138, which are sequentially disposed in this order. The electron beams 'e' may be multiplied through the injection port 132, the multiplying tube 136, and the outlet port 138. In an example, electron beams 'e' may be multiplied by about $10^4$ to about $10^9$ times.

The injection port 132 may be disposed adjacent to the rear surface plate 124 of the microchannel plate 120. The injection port 132 may have a conical shape. The injection port 132 may receive the electron beams 'e' from the microchannel plate 120. to thereby multiply the electron beams 'e'. The first electrode 133 may apply a negative voltage to the injection port 132. In an example, the first electrode 133 may apply a voltage substantially the same as the voltage of the rear surface plate 124 of the microchannel plate 120. For example, the voltage which the first electrode 133 applies to the injection port 132 may be about −3000V to about −1000 V. The multiplying tube 136 and the outlet port 138 may multiply the electron beams 'e'. The second electrode 134 may apply a negative voltage to the outlet port 138. In an example, the second electrode 134 may apply a voltage higher than the voltage of the rear surface plate 124 to the outlet port 138. For example, the voltage which the second electrode 134 applies to the outlet port 138 may be about −200 V to about 0 V.

The inlet electrode 140 may increase the linearity of the electron beams 'e' in the channeltron electron multiplier 130 to thereby direct the electron beams 'e' toward the outlet port 138. Accordingly, the electron beams 'e' in the channeltron electron multiplier 130 may be emitted to the outside of the outlet port 138 without loss. In an example, the voltage of the inlet electrode 140 may be about −200 V to about 0V. The ion lens 150 may focus the electron beams 'e' emitted from the outlet port 138. The ion lens 150 may have a negative voltage. In an example, the ion lens 150 may have a voltage higher than the voltage applied to the rear surface plate 124 of the microchannel plate 120. The gate electrode 160 may block or allow the electron beams 'e' which have passed through the ion lens 150 to be injected into an ionization part 200. For example, the gate electrode 160 may have on/off states. While the gate electrode 160 is in an on-state, the electron beams 'e' having passed through the ion lens 150 may pass through the gate electrode 160 to thereby be injected into the ionization part 200. While the gate electrode 160 is in an off-state, the electron beams 'e' having passed through the ion lens 150 may not be injected into the ionization part 200.

An ionization part 200 generating ions I may be provided. Ions I may be generated by using the electron beams 'e' injected from the cold electron supply part 100. The ionization part 200 and the cold electron supply part 100 may share an inner space. Accordingly, the ionization part 200 may have a vacuum state substantially the same as the cold electron supply part 100. In an example, the inner space of the ionization part 200 may have a pressure of about $10^{-10}$ Torr to about $10^{-4}$ Torr. The ionization part 200 may include a sample part 210 in which a sample is disposed; and a mesh part 220 spaced apart from the sample part 210 in the direction perpendicular to the surface of the sample part 210. The mesh part 220 enables ions I emitted from the sample part 210 to have linearity. The mesh part 220 may have a grid shape. The ions I may pass through the mesh part 220.

A positive voltage may be applied to the sample part 210, and a negative voltage may be applied to the mesh part 220. Accordingly, an electric field may be formed between the sample part 210 and the mesh part 220. The electric field may have a direction from the sample part 210 toward the mesh part 220. The electron beams 'e' injected into the ionization part 200 may be bent toward the sample part 210 by being forced by an electric field in the direction toward the sample part 210. A sample on the sample part 210 collides with the electron beams 'e' to thereby emit ions I.

In an example, a gas sample G may be injected on the sample part 210. For example, the gas sample G may be injected on the sample part 210 through a pulse method. The gas sample G may be adsorbed on the surface of the sample part 210. The sample adsorbed on the surface of the sample part 210 may collide with the electron beams 'e' injected in the cold electron supply part 100. Accordingly, ions I may be emitted from the sample. Ions I may include ions I having masses different from each other according to the composition of the sample. The ions I assume positive charges and may be forced in the direction from the sample part 210 toward the mesh part 220. The ions I may move to an ion separation part 300 through the mesh part 220. In an example, two or more mesh parts 220 may be provided. At this time, the mesh parts 220 may be disposed parallel to each other.

An ion separation part 300 in which ions I having passed through the mesh part 220 are injected may be provided. The ion separation part 300 may have a straight tube shape. The ion separation part 300 may share an inner space with the ionization part 200 and the cold electron supply part 100 to thereby have a vacuum state. In an example, the inner space of the ion separation part 300 may have a pressure of about $10^{-10}$ Torr to about $10^{-4}$ Torr. The ions I generated in the ionization part may move to the ion detection part 400 through the ion separation part 300. The ion separation part 300 may extend from the surface of the sample part 210 in the direction perpendicular to the surface. The moving speed of ions I having relatively small masses may be faster than those of ions I having relatively great masses. The ions I having masses different from each other may have ion separation part-passing times different from each other.

An ion detection part 400 detecting the ions I having passed through the ion separation part 300 may be provided. The ion detection part 400 may share an inner space with the ion separation part 300, the ionization part 200 and the cold electron supply part 100 to thereby have a vacuum state. In an example, the inner space of the ion detecting 400 may have a pressure of about $10^{-10}$ Torr to about $10^{-4}$ Torr. In an example, the ion detecting 400 may include a microchannel plate (not shown) and/or a channeltron electron multiplier (not shown). At this time, the microchannel plate and the channeltron electron multiplier may be substantially the same as the microchannel plate 120 and the channeltron electron multiplier 130 which are included in the cold electron supply part 100. For example, ions I may be injected into the microchannel plate and/or the channeltron electron multiplier to thereby induce electrons. Electrons are amplified in the microchannel plate and/or the channeltron electron multiplier to be thereby detected by a detection circuit (not shown). When ions I having relatively small masses and ions I having relatively great masses simultaneously enter the ion separation part 300, the ions I having relatively small masses may be detected earlier than the ions I having relatively great masses. The longer the length of the ion separation part 300, the greater the difference in times within which the ions I having different masses different from each other be detected.

The smaller the difference in an ionizing time within which molecules having masses different from each other collides with electron beams 'e' to emit ions, the higher the accuracy of a time-of-flight mass spectrometer. When cold electrons are used as an ionization source, the differences in the ionizing time of the ions having masses different from each other may be several to several hundred nanoseconds. Accordingly, a time-of-flight mass spectrometer including the cold electron supply part 100 may have a high accuracy.

Even when the length of the ion separation part 300 by using cold electrons as ionization source is formed smaller that that in the case of using an ionization source other than cold electrons, a time-of-flight mass spectrometer having a required accuracy may be obtained. Accordingly, a time-of-flight mass spectrometer suitable for miniaturization may be provided. In addition, the time-of-flight mass spectrometer according to an exemplary embodiment may have small power consumption by using a ultraviolet diode.

Figure 3:
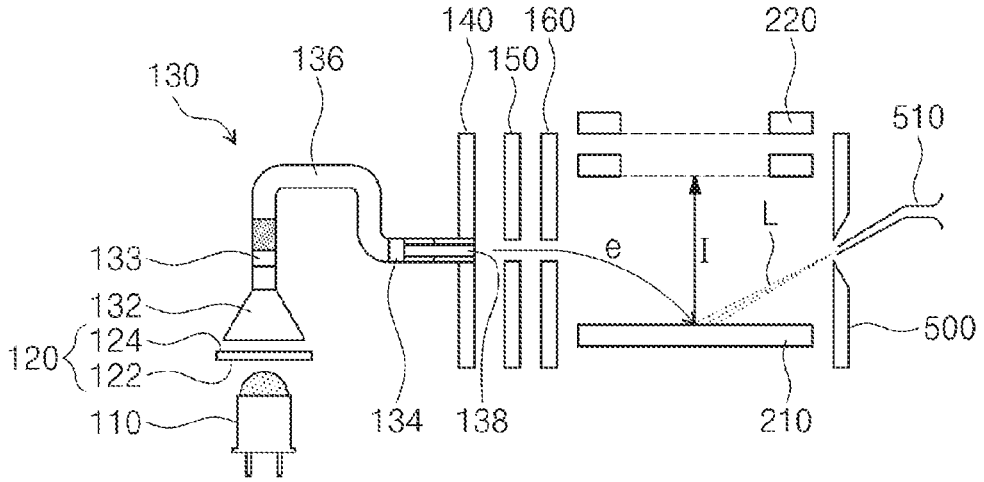
FIGS. 3 to 5 are cross-sectional views of a cold electron supply part and an ionization part of a time-of-flight mass spectrometer according to an embodiment of the present invention.
Figure 4:
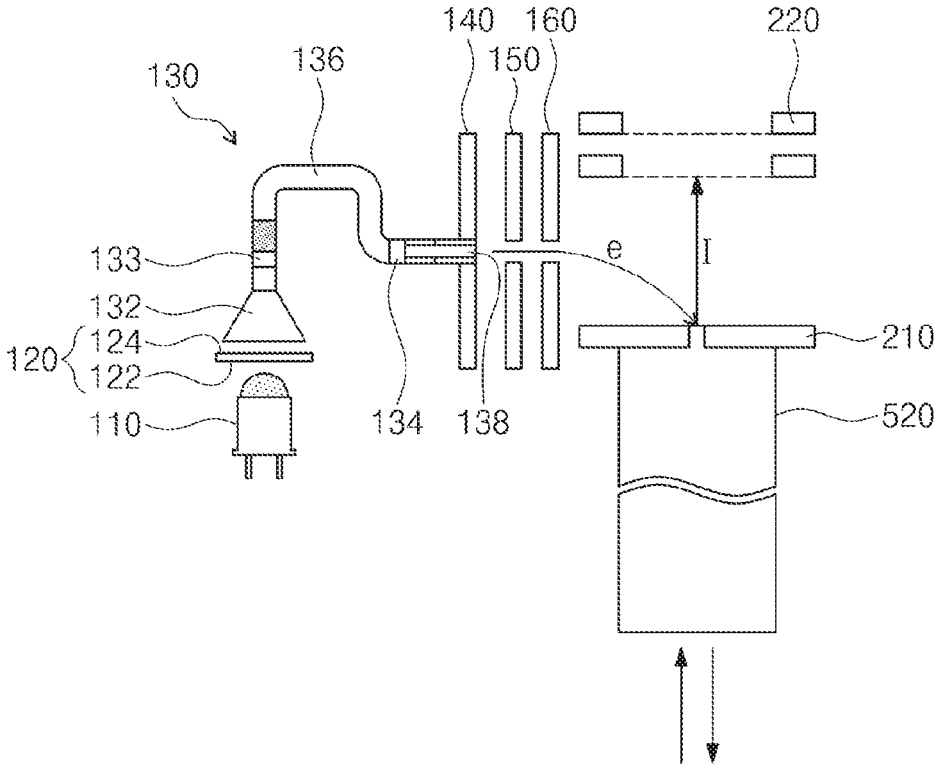
Figure 5:
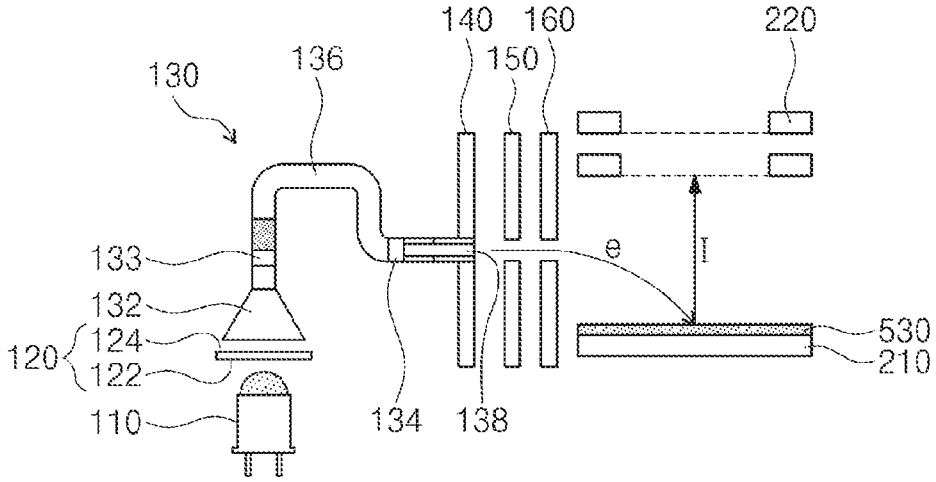

FIGS. 3 to 5 are cross-sectional views of a cold electron supply part and an ionization part of a time-of-flight mass spectrometer according to an embodiment of the present invention. For simplicity in description, descriptions substantially the same as those described with reference to FIGS. 1 and 2 may not be provided.

Referring to FIG. 3, a liquid sample L may be provided on the sample part 210. The liquid sample L may be sprayed on the sample part 210 through a sample supply nozzle 510. The liquid sample L may be adsorbed on the surface of the sample part 210. The liquid sample collides with the electron beams 'e' to thereby generate ions I. Ions I may pass through the ion separation part to be thereby detected in the ion detection part.

Referring to FIG. 4, a solid sample rod 520 may be used as a sample. The solid sample rod 520 may collide with the electron beams 'e' to thereby generate ions I. Ions I may pass through the ion separation part to be thereby detected in the ion detection part.

Referring to FIG. 5, a matrix sample, a carbon nano-tube (CNT) or graphene 530 may be provided on the sample pat 210. The matrix sample, the carbon nano-tube (CNT) or graphene 530 may collide with the electron beams 'e' to thereby generate ions I. Ions I may pass through the ion separation part to be thereby detected in the ion detection part.

The above description on embodiments of the present invention provides exemplary examples for describing the present invention. Thus, the present invention is not limited to the above-described embodiments, and it would be clarified that various modifications and changes, for example, combinations of the above embodiments, could be made by those skilled in the art within the technical spirit and scope of the present invention.

The invention claimed is:

1. A time-of-flight mass spectrometer comprising:

an ionization part receiving electron beams and to thereby emit ions;

a cold electron supply part injecting the electron beams to the ionization part;

an ion detection circuit part detecting the ions emitted from the ionization part; and an ion separation time-of-flight tube part connecting the ionization part and the ion detection circuit part, wherein the cold electron supply part comprises a microchannel plate receiving ultraviolet rays to thereby emit the electron beams, the cold electron supply part further comprises a channeltron electron multiplier multiplying the electron beams emitted from the microchannel plate, the ionization part comprises a sample part on which a sample collides with the electron beams to thereby generate ions and a mesh spaced from the sample part in a direction perpendicular to a surface of the sample part, wherein the mesh has a voltage with a polarity that is opposite to a voltage polarity of the sample part, wherein the sample comprises at least one of a solid sample and a gas sample adsorbed on the surface of the sample part, the ions emitted from the ionization part pass through the ion separation time-of-flight tube part to thereby reach the ion detection circuit part, and the ion separation circuit part has a straight tube shape.

2. The time-of-flight mass spectrometer of claim 1, wherein the cold electron supply part further comprises an ultraviolet diode emitting the ultraviolet rays toward the microchannel plate.

3. The time-of-flight mass spectrometer of claim 1, wherein the microchannel plate comprises:

a front surface plate receiving the ultraviolet rays to thereby generate electrons; and a rear surface plate emitting the electron beams, wherein the electron beams are electrons multiplied in the microchannel plate.

4. The time-of-flight mass spectrometer of claim 3, wherein the multiplication ratio is $10^4$ times to $10^9$ times.

5. The time-of-flight mass spectrometer of claim 1, wherein the channeltron electron multiplier multiplies the electron beams emitted from the microchannel plate by $10^4$ times to $10^9$ times.

6. The time-of-flight mass spectrometer of claim 1, wherein the cold electron supply part further comprises an ion lens focusing the electron beams multiplied through the channeltron electron multiplier to thereby emit the electron beams toward the ionization part.

7. The time-of-flight mass spectrometer of claim 6, wherein the cold electron supply part further comprises a gate electrode blocking or allowing the electron beams emitted from the ion lens to be injected into the ionization part.

8. The time-of-flight mass spectrometer of claim 1, wherein the ion detection circuit receives the ions to thereby generate, amplify, and detect electrons and comprises a microchannel plate or channeltron electron multiplier which amplifies the electrons.

9. The time-of-flight mass spectrometer of claim 1, wherein the time-of-flight mass spectrometer has an inner space in vacuum.

10. The time-of-flight mass spectrometer of claim 1, wherein the time-of-flight mass spectrometer has a pressure of $10^{-10}$ Torr to $10^{-4}$ Torr in the inner space.

11. The time-of-flight mass spectrometer of claim 1, wherein the ionization part further comprises a sample supply part supplying the sample on the sample part.

12. The time-of-flight mass spectrometer of claim 11, wherein the sample supply part sprays a gas sample to the sample part and the gas sample is adsorbed on an upper surface of the sample part.

13. The time-of-flight mass spectrometer of claim 12, wherein the sample supply part supplies the gas sample on the sample part through a pulse method.

14. The time-of-flight mass spectrometer of claim 12, wherein the sample supply part sprays a liquid sample on the sample part and the liquid sample is adsorbed on the sample part.

15. A time-of-flight mass spectrometer comprising:

an ultraviolet diode configured to emit ultraviolet rays;

a microchannel plate having a front surface plate facing the ultraviolet diode and a rear surface plate disposed opposite the front surface plate, wherein the front surface plate is configured to receive the ultraviolet rays and the rear surface plate is configured to emit electron beams;

a channeltron electron multiplier comprising:

an injection port disposed adjacent the rear surface plate and configured to receive the electron beams from the rear surface plate, a first electrode configured to apply a voltage to the injection port, a multiplying tube configured to multiply the electron beams, a second electrode, and an outlet port configured to multiply and emit the electron beams, wherein the second electrode is configured to apply a voltage to the outlet port;

an inlet electrode configured to increase the linearity of the electron beams emitted from the outlet port such that the electron beams may be emitted from the outlet port without loss;

an ion lens configured to focus the electron beams emitted from the outlet port;

a gate electrode configured to block some of the electron beams focused by the ion lens and allow to pass through some of the electron beams focused by the ion lens;

a sample part having a sample configured to collide with the electron beams that pass through the gate electrode, to thereby generate ions and a mesh spaced from the sample part in a direction perpendicular to a surface of the sample part, wherein the mesh has a voltage with a polarity that is opposite to a voltage polarity of the sample part, wherein the collisions generate and emit ions, and wherein the sample comprises at least one of a solid sample and a gas sample adsorbed on the surface of the sample part; and an ion detector circuit disposed at an end of an ion separator time-of-flight tube, wherein the ion detector circuit is configured to detect the ions.

16. The time-of-flight mass spectrometer of claim 15, wherein photoelectrons of the ultraviolet rays are multiplied inside the microchannel plate to generate the electron beams.

17. The time-of-flight mass spectrometer of claim 15, wherein the voltage the first electrode is configured to apply to the injection port is substantially the same as a voltage of the rear surface plate, the voltage the second electrode is configured to apply to the outlet port is larger than the voltage of the rear surface plate, and a voltage of the ion lens is larger than the voltage of the rear surface plate.

18. The time-of-flight mass spectrometer of claim 15, further comprising a mesh spaced from the sample part in a direction perpendicular to a surface of the sample part, wherein the mesh has a voltage with a polarity that is opposite to a voltage polarity of the sample part, wherein an electric field is formed between the sample part and the mesh, wherein the electron beams are forced toward the sample part by the electric field, and wherein the ions are forced from the sample part toward the mesh by the electric field.

19. The time-of-flight mass spectrometer of claim 15, wherein the ultraviolet diode is configured to use a current of several milliAmps (mA) to several hundred mA for several micro-seconds (ms) to several hundred ms to emit the ultraviolet rays.

* * * * *